US006457559B1

(12) United States Patent
Schlueter et al.

(10) Patent No.: US 6,457,559 B1
(45) Date of Patent: Oct. 1, 2002

(54) FOLDABLE LADDER

(76) Inventors: Mark R. Schlueter, # 3 Woodland Dr., Athens, IL (US) 62613; Tami Lee Schlueter, # 3 Woodland Dr., Athens, IL (US) 62613

( * ) Notice: Subject to any disclaimer, the term of this patent is extended or adjusted under 35 U.S.C. 154(b) by 0 days.

(21) Appl. No.: 10/046,905

(22) Filed: Jan. 17, 2002

Related U.S. Application Data

(63) Continuation of application No. 09/626,069, filed on Jul. 26, 2000, now abandoned.

(51) Int. Cl.[7] ..... E06C 1/00
(52) U.S. Cl. ..... 182/159; 182/96; 182/160
(58) Field of Search ..... 182/159, 160, 182/96, 161, 162, 156, 152, 228

(56) References Cited

U.S. PATENT DOCUMENTS 1,314,201 A * 8/1919 Moore ..... 182/159
3,370,865 A * 2/1968 Baldwin ..... 182/159
4,612,848 A * 9/1986 Pollack ..... 182/159 X
4,934,485 A * 6/1990 Purkapile ..... 182/20
5,170,862 A * 12/1992 Chang ..... 182/159
5,868,222 A * 2/1999 Charbonneau ..... 182/172
5,944,141 A * 8/1999 Kochan et al. ..... 182/159 X
5,967,257 A * 10/1999 Begin et al. ..... 182/159 X
6,119,811 A * 9/2000 Tsung-Ping ..... 182/159 X
6,145,621 A * 11/2000 Nye ..... 182/159
6,318,498 B1 * 11/2001 Warner ..... 182/159 X

* cited by examiner

*Primary Examiner*—Bruce A. Lev
(74) *Attorney, Agent, or Firm*—Patent & Trademark Services; Thomas Zack; Joseph H. McGlynn

(57) ABSTRACT

A foldable ladder having two rails with several rungs pivotally mounted on each end to rail extensions. The rail extensions are fixed to the rails and extend towards each other. A pivot joint in each rail extension connects a common rung to allow the rung to be pivoted on two of its ends. To prevent the normally pivotally joined rungs from moving when the ladder is in an opened position, a bracket is slidably mounted on the top and bottom ladder rungs.

4 Claims, 3 Drawing Sheets

FOLDABLE LADDER

This is a continuation of Ser. No. 09/626,069, filed Jul. 26, 2000, now abandoned.

BACKGROUND OF THE INVENTION

This invention relates in general to a foldable ladder, and in particular to a foldable ladder with sliding latches to maintain the ladder in an open position.

DESCRIPTION OF THE PRIOR ART

Ladders that fold or collapse are known in the prior art. By folding the ladder the user is able to more easily transport and store the collapsible structure than when in an opened position. At the same time this type of ladder must be safe to use when in an opened position to insure users will not be injured when ascending or descending the rungs.

Folding ladder and associated components are known in the art. For example, U.S. Pat. No. 1,314,201 to Moore discloses a folding ladder in which the vertical rungs fold on themselves.

U.S. Pat. No. 1,606,445 to Pirsch discloses a folding ladder that has cross rungs which pivot to allow the ladder to fold at one or more cross braces.

U.S. Pat. No. 4,842,099 to Collet et al discloses a folding ladder that has cross rungs which pivot to allow the ladder to fold and a pair of pivoting cross braces.

U.S. Pat. No. 5,170,862 to Chang discloses a locking device for a step ladder.

U.S. Pat. No. 5,685,394 to Simson discloses a folding ladder with a pair of cross braces to hold the ladder in an open position.

In the present invention at least two cross rungs having sliding stops which prevent the otherwise foldable rungs from folding when in an opened position. As an added option, a removable pair of wheels with a connecting axle can be attached to the ladder, when in an opened position, to permit the ladder to carry cargo, all as will be detailed in the specification that follows hereafter.

SUMMARY OF THE INVENTION

This invention relates to a foldable ladder having locking brackets on the rungs to maintain the ladder in an opened position.

It is the primary object of the present invention to provide for an improved foldable ladder that can safely support a user while in the opened position.

Another object is to provide for such a ladder in which slidable stops on at least two rungs prevent the ladder from folding when in an opened position.

An additional further object to provide such a ladder having a pair of detachable wheels and supports for carrying cargo when the ladder is in an opened position.

These and other objects and advantages of the present invention will become apparent to readers from a consideration of the ensuing description and the accompanying drawings.

DESCRIPTION OF THE PREFERRED EMBODIMENT

Figure 1:
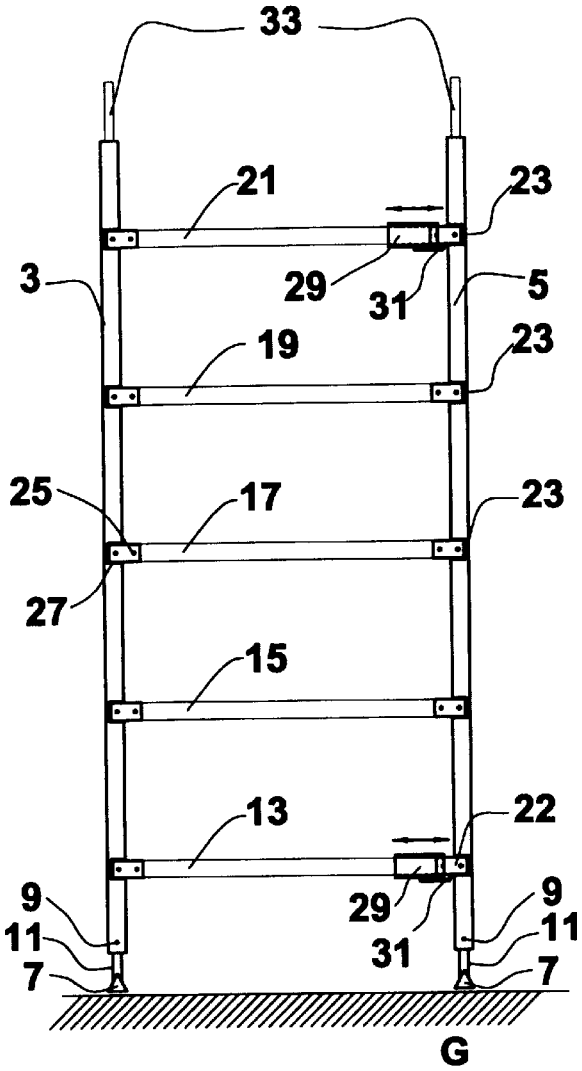
FIG. 1 is a front view showing the ladder in an open position.

FIG. 1 is a front view showing the ladder 1 of the present invention in an open position. Two parallel rails 3 and 5 are vertically disposed and supported at their lower ends by adjustable feet 7. Each rail is spaced from the other rail along its length. The feet 7 permit the rails to be raised or lowered small distances. Locking pins 9 extend into holes in the rails and engage upper extensions of the feet inserted within the rails to fix these two members together. Spaced aligned holes within the feet extensions 11 permit the locking pins to adjust the heights within limits. The adjustable feet allow the ladder to be used on uneven supporting surfaces.

Several parallel rungs 13, 15, 17, 19 and 21 extend between the two parallel rails. All of the rungs have the same construction. Rail extensions 22 extend perpendicular to the lengths of each rail. The rail extensions on rungs 13, 17, and 21 are longer than the extensions on the other rungs for better locking performance and, are also used to secure the closed ladder. Each extension is welded to the rail at 23 and a rung engaging bolt 25 is used to pivotally fixed the extension to the rung. For each rung two rail extensions are aligned in pairs and extend inwardly from the two rails towards each other.

The weld 23, for each rail extension, fixes the extensions 22 to their respective rails. The two rung engaging bolts 25 pivotally join the individual rungs 13, 15, 17, 19 and 21 to the rail extensions 22 of each rail 3 and 5. This construction allows the rungs to pivot on each of the pivot bolts 25 to collapse, or fold, the rails towards each other. For example, rung 17 is shown with its two ends pivotally joined to the opposite and aligned rail extensions 22.

Placing a downward load on the rungs of the ladder would normally cause the rungs to pivot on their end bolts were it not for the two slidable clamp brackets 29. One bracket 29 is located on top rung 21 and another bracket on the bottom rung 13. These brackets, described in more detail in FIG. 5, act to prevent the two engaged rungs from pivoting, and this locking action also prevents the intermediate rungs from pivoting, as all rungs are attached to the same rigid opposite rails 3 or 5 at their ends.

By restricting the pivotal movement of two of the rungs, here the top and bottom rungs, all of the rungs are prevented from moving in a pivotal manner whether they have the brackets 29 on them or not. Brackets 29 act like restricting collars to fit around the width of the rungs 21 and 13 and can move, within limits, along the length of these rungs. A flexible biased right angled stop 31 (e.g., see bracket 29 on rung 13) extends from the main housing bracket collar of bracket 29 to engage the rail extension 22 when sliding into engagement. When so placed the bracket is locked to prevent the movement of the rung. An upper rail extension 33 may extend from within each rail and be used to stack another similar ladder having a hollow extension receiving end rail to increase the combined height of the two stacked ladders.

Figure 2:
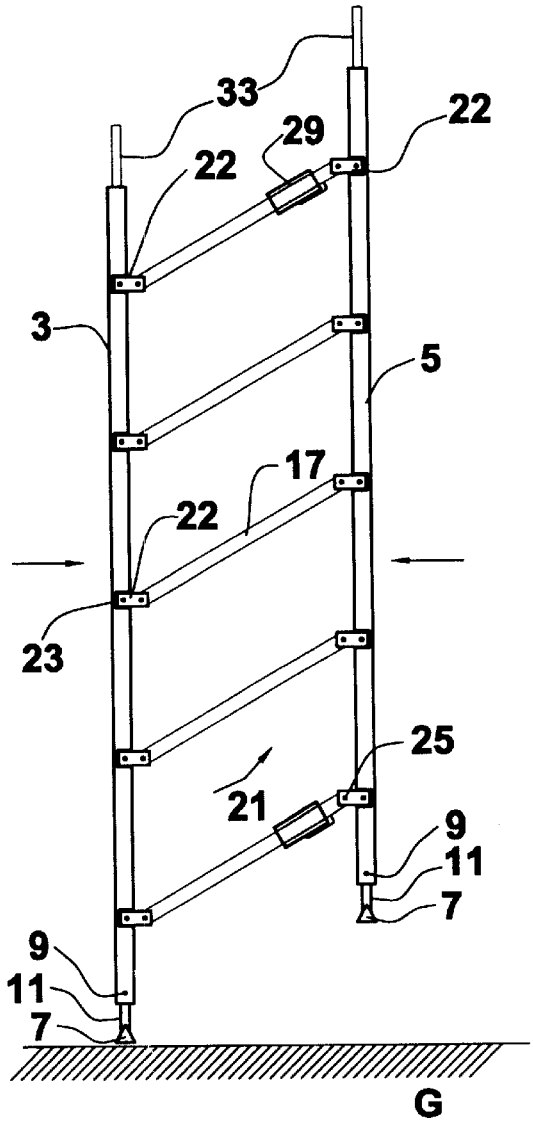
FIG. 2 is a front view of the present invention as it is moved to a folded position.

FIG. 2 is a front view of the ladder of FIG. 1 as it is moved to a folded position. With the brackets 29 and their stops 31 moved from engagement with the two opposite end rail extensions 22, the two rails 3 and 5 may be collapsed or folded towards each other (see arrows) at the end pivots 25. Eventually the two parallel rails 3 and 5 will approach each other closer than shown in FIG. 2 with the interposed pivoted rungs preventing them from actually touching each other. In the rail extension 22, for rung 17, there is a through hole 24 which extends into the rung in which a pin or padlock leg (not shown) can be inserted to lock the closed ladder in position for transport ion or for nonfunctional use.

Figure 3:
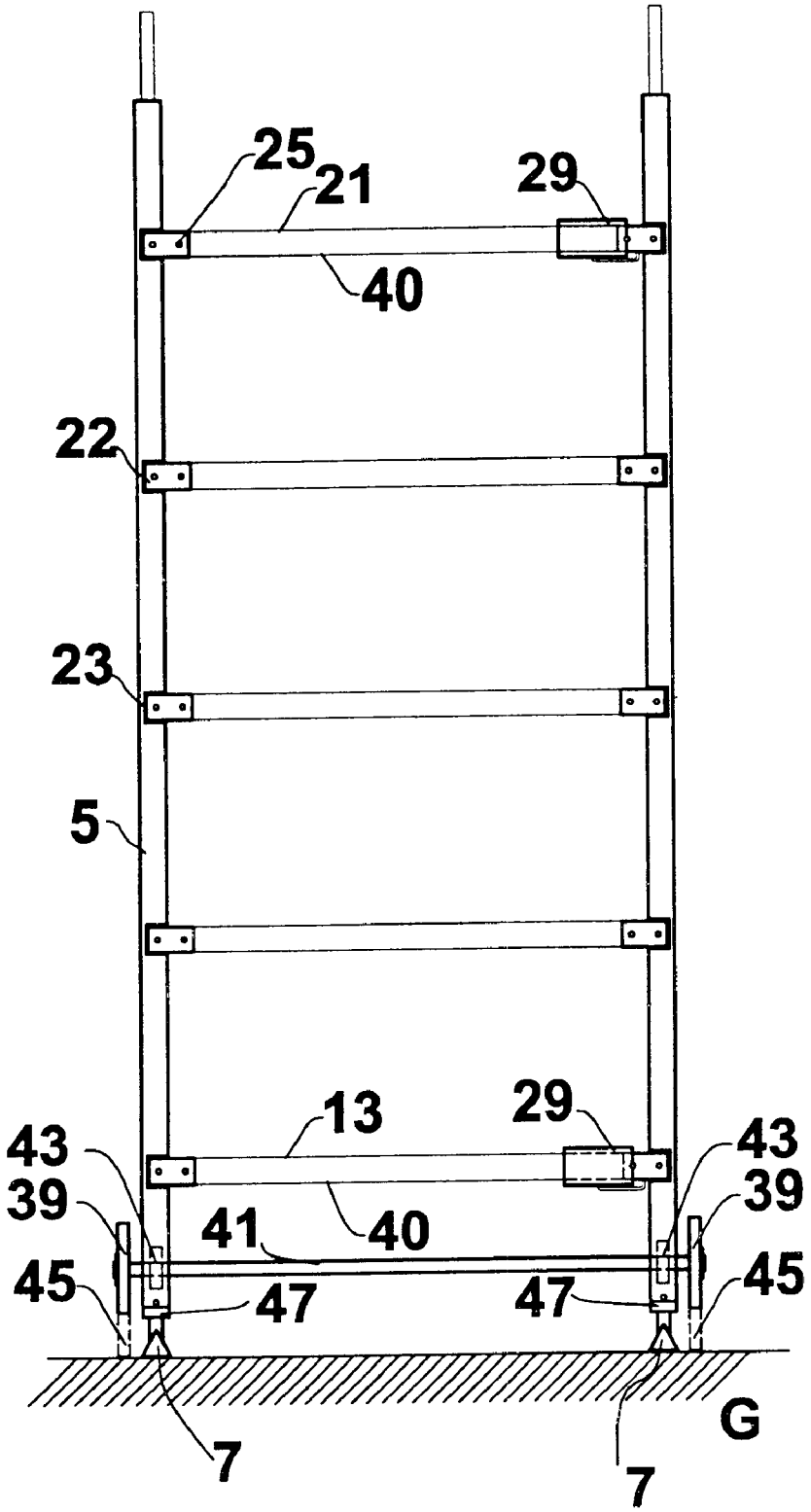
FIG. 3 is a front view of the present invention showing the detachable wheels and cargo supports.

FIG. 3 is a front view of the opened ladder of FIG. 1 with added detachable wheels 39 and lower cargo supports 47. A straight axle 41 mounts the two wheels 39 at each of its ends and is joined to the lower portions of the two rails by two conventional clips 43. These clips can encircle the axle along its length and may be rigidly attached to the rails at their other ends. The outer circumference of the two wheels 39 is such that there is a space 45 between the ground G and each wheel when the ladder is in a vertical position, as shown. This insures the weight on the ladder is placed directly on the feet 7 and not on the wheels. Extending from each of the rails 3 and 5 are lower cargo supports 47. These two supports are oriented at approximately right angles to the rails, extend away from them and, are rigidly fixed to each of them.

With these added removable wheels 39 and the cargo supports 47, the horizontally disposed opened ladder would function like a cargo dolly and be able to transport cargo, like a hunters kill, by engaging the wheels against the ground G as the top of the ladder is moved towards the horizontal. The end of the ladder opposite the wheels would be lifted from the ground and held by the user to roll the ladder and its cargo along the ground. If it is desired that the wheels not be used, they may simply be detached from the rails along with their axle 41 by removing the holding clips 43 from the rails. Welded bead stops 40 on rungs 13 and 21 prevent the brackets 29 from binding up while folding up the ladder.

Figure 4:
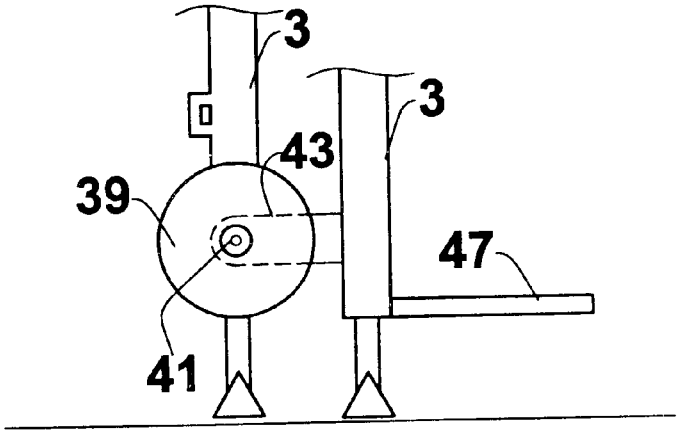
FIG. 4 is a lower side view of the FIG. 3 addition showing it mounted to one of the rails.

FIG. 4 is a lower side view of the ladder shown in FIG. 3 showing how each wheel and cargo support is mounted to one of the rails. In FIG. 4, only the lower portion of the rail 3 is shown. The two spaced wheels 39, one shown, are each mounted by an axle engaging clip 43, which also extends into the rail 3. A spring U-shaped clip, whose free ends engage rail holes, may be used for this purpose. Regardless of the conventional type of attachment mechanism used, the two wheels 39 and their supporting axle 41 are all detachably mounted to the rails 3 and 5. Extending from the other side of each of the rails 3 and 5 are two cargo supports 47 that are part of the adjustable feet. These supports may be welded on each rail or may be detachably secured to them.

Figure 5:
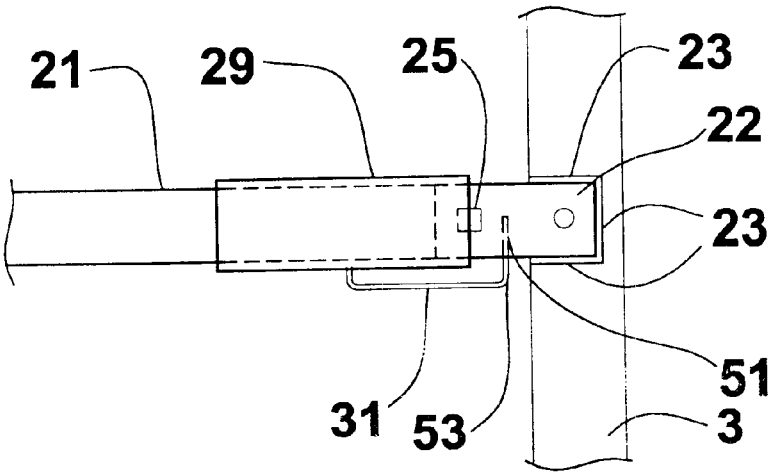
FIG. 5 is an enlarged view of the locking bracket engaging a rail extension of the ladder.

FIG. 5 is an enlarged, and more detailed front view, of the locking bracket 29 shown engaging a rail extension 22 of the ladder. In this figure upper rung 21 was selected for illustration purposes and should be understood that lower rung 13 would be constructed and operate in the same manner. The rail extension 22 is rigidly fixed to the rail 3 by a weld 23 extending to three sides while the pivot bolt 25, partially shown, fixes the rung 21 to the extension. A spring biased right angled stop 31, fixed at its vertical left side arm to the outside of bracket 29, has a free end that can engage a hole 51 located on the underside of the extension 22. Since the unfixed portion of stop 31 is flexible and spring biased to move upwardly, engaging stop free end side 53 will be forced into the extension hole and retained therein until removed by hand. As long as the two brackets 29 are placed over the pivots in the rail extensions, the rungs 21 and 13 will not be able to pivot around the pivot bolts 25 due to the interference of the rigid collar like bracket over them. This configuration insures the opened ladder will not fold to a closed position when a load is placed on any of its rungs. To fold the opened ladder simply remove the end 53 from hole 51 and slide the bracket 29 along the rung to the left to a position nearer the mid portion of the rung, and then pass the previously covered pivot connection on the rail extension. When so done, the two opposite side rails of the ladder may be collapsed towards each other with the rungs, now slanted with respect to the rails and still parallel to each, interposed between the now closely spaced rails.

When the wheel assembly, and its associated front supports 47, are used with the foldable ladder, any type cargo may be placed on tied to the opened ladder for transport. This includes, but is not limited to, hunting gear cargo, game kill, weapons, and related subjects. This added additional use of the folding ladder is particularity useful when a ladder and a cargo carrier are both needed in one device.

Variations may be made to the disclosed embodiment of the invention. Many types of different material can be used to construct the ladder with various sizes. In one embodiment the ladder was made of metal, had an overall height of 5 feet and was 18.5 inches wide with five rungs. Almost any color could be used for the ladder, including camouflage and solid designs, and any style of design to suit the tastes of a wide variety of users.

Although the preferred embodiment of the present invention and the method of using the same has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What we claim as our invention is:

1. A foldable ladder comprising:

a first rail having a length and a second rail having a length, each of said rails being spaced apart and generally parallel to each other along their lengths;

said first rail and said second rail each having a plurality of rail extensions fixed to the rails and facing generally perpendicular to the rails, each rail extension on the first rail facing towards a rail extension of the second rail;

a plurality of rungs consisting of separate rungs extending between said first rail and said second rail, each of said separate rungs having two ends, each of the rail extensions of said first rail having a first pivot joint and an opposite rail extension on the second rail having a second pivot joint, said first pivot joint being connected to one of the two ends of the each of the separate rungs, said second pivot point being connected to a separate rung at an end of the rung opposite said first pivot joint, said first rail and said second rail being foldable from a first opened position to a second closed position, said first rail and said second rail remaining in the same plane and generally parallel when in the first opened position and in the second closed position, two brackets slidably mounted on two separate rungs between the first rail and the second rail, said brackets having a rail extension engaging member to retain the bracket to the rail extension when slid into position to thereby prevent the rung from pivoting on the pivot points, each of said slidably mounted brackets having a collar with a biased extension that extends from the collar, said biased extension having a free end for releasably engaging a rail extension to retain the bracket to the rail extension, and said rail extensions having a hole to receive said free end of the biased extension to retain the collar to the rail extension.

2. The foldable ladder as claimed in claim 1, wherein there are at least four rail extensions on each rail with a rung pivotally mounted between the rail extensions of each rail.

3. The foldable ladder as claimed in claim 2, also including removable rollable members mounted to said first rail and second rails and a cargo support extending outwardly from the rails on the opposite rail sides on which the rollable members are mounted.

4. The foldable ladder as claimed in claim 1, wherein there are at least three separate rungs, each of said separate rungs being generally parallel to the other two separate rungs, the top separate rung of said three separate rungs and the bottom separate rung of said three separate rungs being the only separate rungs with a slidably mounted brackets.

* * * * *